US007021178B1

(12) United States Patent
Richardson

(10) Patent No.: US 7,021,178 B1
(45) Date of Patent: Apr. 4, 2006

(54) BOAT CAP REMOVER

(76) Inventor: Phillip Richardson, 900 Bay Dr. #119, Miami Beach, FL (US) 33141

( * ) Notice: Subject to any disclaimer, the term of this patent is extended or adjusted under 35 U.S.C. 154(b) by 0 days.

(21) Appl. No.: 10/934,218

(22) Filed: Sep. 2, 2004

(51) Int. Cl.
*B25B 13/48* (2006.01)

(52) U.S. Cl. ..... 81/461; 81/176.15

(58) Field of Classification Search ..... 81/461, 81/176.1, 176.15, 119
See application file for complete search history.

(56) References Cited

U.S. PATENT DOCUMENTS

| | | | | |
|---|---|---|---|---|
| 3,043,171 | A | 7/1962 | Lederer | |
| 4,033,205 | A | 7/1977 | Hoskins | |
| 4,336,729 | A * | 6/1982 | Eppenbach | 81/439 |
| 5,588,342 | A | 12/1996 | Ahlgren et al. | |
| 5,768,961 | A | 6/1998 | Frawley | |
| 5,845,552 | A * | 12/1998 | Piascik | 81/461 |
| 6,076,435 | A * | 6/2000 | White et al. | 81/176.2 |
| 6,280,620 | B1 * | 8/2001 | Duran | 210/238 |
| 6,752,049 | B1 * | 6/2004 | White | 81/461 |
| 6,840,140 | B1 * | 1/2005 | Wenacur | 81/176.3 |
| 2002/0139225 | A1 * | 10/2002 | Carter | 81/176.3 |

* cited by examiner

*Primary Examiner*—David B. Thomas

(57) ABSTRACT

An apparatus designed for use with boats to assist a user in removing tank caps on a boat. The apparatus is a removal apparatus which is capable of being inserted into a pair of holes located on a tank cap located on a boat, with the user being able to grasp a handle attached to the removal socket to effectively turn the removal apparatus. An individual is able to turn the handle clockwise or counterclockwise, respectively, to tighten or loosen the boat cap as needed.

5 Claims, 2 Drawing Sheets

BOAT CAP REMOVER

I. BACKGROUND OF THE INVENTION

The present invention is an apparatus designed for use with boats, and more particularly, is an apparatus designed to assist a user in removing tank caps on a boat.

II. DESCRIPTION OF THE PRIOR ART

U.S. Pat. No. 5,588,342, issued to Ahlgren et al., discloses a device for removing a cork from a bottle incorporating a lazy tongs link mechanism wherein manual force is applied along the bottle axis.

U.S. Pat. No. 5,768,961, issued to Frawley, discloses a self-adjusting sock for a wrench handle having a drive end with a ratchet reverse lever and a square peg.

U.S. Pat. No. 4,033,205, issued to Hoskins, discloses a wrench for container closures such as jar caps and bottle caps that comprises a supporting plate and an operating plate that is turned relative to the supporting plate by a handle.

U.S. Pat. No. 3,043,171, issued to Lederer, discloses a device for removing oil filters.

III. SUMMARY OF THE INVENTION

The present invention is an apparatus designed for use with boats to assist a user in removing tank caps on a boat. The apparatus comprises a removal apparatus which is capable of being inserted into a pair of holes located on a tank cap located on a boat, with the user being able to grasp a handle attached to the removal socket to effectively turn the removal apparatus. An individual would be able to turn the handle clockwise or counterclockwise, respectively, to tighten or loosen the boat cap as needed.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regard as including such equivalent constructions insofar as they do not depart from the spirit and scope of the present invention.

It is therefore an object of the present invention to provide a new and improved boat cap remover which has all of the advantages of the prior art and none of the disadvantages.

It is another object of the present invention to provide a new and improved which boat cap remover may be easily and efficiently manufactured and marketed.

It is another object of the present invention to provide a new and improved boat cap remover which is of durable and reliable construction.

It is yet another object of the present invention to provide a new and improved boat cap remover, which is economically affordable and available to the buying public.

Other objects, features and advantages of the present invention will become more readily apparent from the following detailed description of the preferred embodiment when considered with the attached drawings and appended claims.

IV. BRIEF DESCRIPTION OF THE DRAWINGS

V. DESCRIPTION OF THE PREFERRED EMBODIMENT

Figure 1:
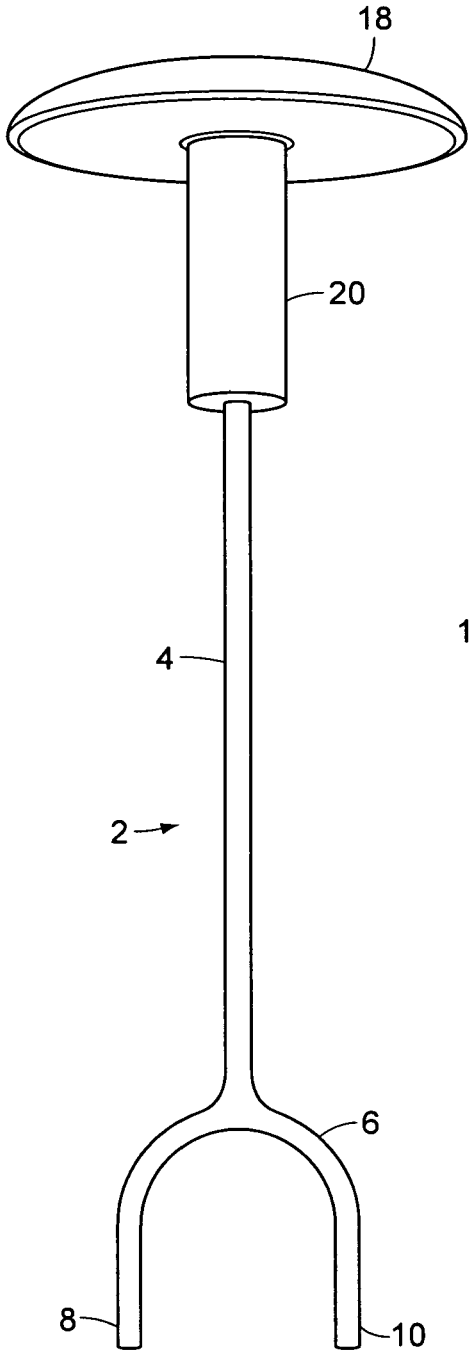
FIG. 1 shows a perspective view of the removal apparatus.

FIG. 1 shows a perspective view of the removal apparatus 2. Removal apparatus 2 comprises main support pole 4, holder 6, first arm 8, and second arm 10. Main support pole 4 has two ends, a first end and a second end.

Handle 18 is used to hold the removal apparatus 2 and give it strength. Handle 18 is a disc-shaped object and has two surfaces, a top surface and a bottom surface. Handle attachment 20 has two ends, a top end and a bottom end, with the top end of the handle attachment 20 being attached to the bottom surface of the handle 18 and bottom end of the handle attachment 20 being attached to the first end of the main support pole 4.

Holder 6 is a U-shaped bracket that has two arms, a first arm 8 and a second arm 10. The second end of the main support pole 4 is attached to the holder 6 halfway in between the first arm 8 and the second arm 10. The first arm 8 and the second arm 10 have the same length as each other and are co-planar with the main support pole 4.

Figure 2:
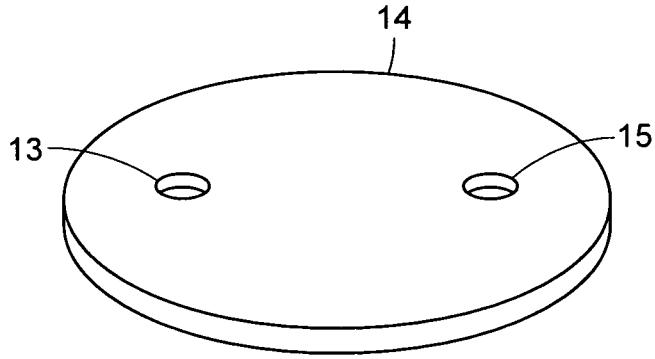
FIG. 2 shows the perspective view of a tank cap on a boat.

FIG. 2 shows a perspective view of a boat cap 14 on a boat. Boat cap 14 would be designed to be any one of a number of caps that would be used to be placed over a tank, including a fuel cap, water cap, waste cap, oil cap, or other such caps commonly used with a boat. The boat cap 14 is usually used to cover a hole granting access to one of these tanks or other mechanical objects.

Boat cap 14 is shown to be disc-shaped and has two surfaces, a top surface and a bottom surface, and also has a continuous perimeter 40. Boat cap 14 has a plurality of external threads 42 located around the perimeter 40 of the boat cap 14 which are used to threadably attach the boat cap 14 to the appropriate hole on a boat.

Boat cap 14 that would be used with the present invention has a pair of holes 13 and 15 evenly spaced apart located on the top surface of the boat cap 14, with each of the holes 13 and 15 being located an equal distance from the center of boat cap 14. Holes 13 and 15, compared to the center of boat cap 14, are located exactly 180 degrees apart from one another. The only effective way to turn boat cap 14 is to insert objects into holes 13 and 15 and tighten or loosen boat cap 14 by turning boat cap 14 clockwise or counterclockwise, respectively.

Figure 3:
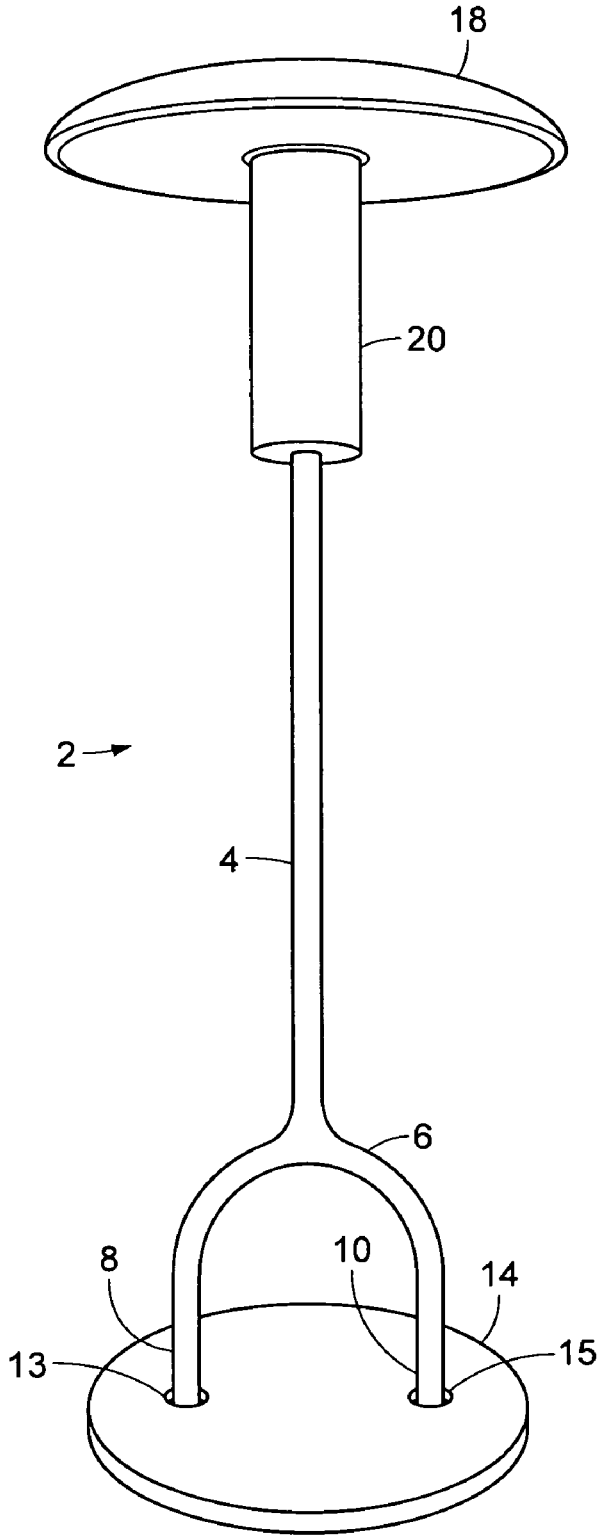
FIG. 3 shows a perspective view of a removal apparatus interacting with a tank cap on a boat.

FIG. 3 shows a perspective view of removal apparatus 2 interacting with boat cap 14. First arm 8 and second arm 10 are being placed within holes 13 and 15 at which time, a user can grasp handle 18 of removal apparatus 2 and either tighten or loosen boat cap 14 by turning clockwise or counterclockwise, respectively.

What I claim as my invention is:

1. An apparatus for removing boat tank caps in combination with a cylindrical boat cap and a boat, the boat cap having two surfaces, a top surface and a bottom surface, the boat cap also having a perimeter, the boat cap having at least two holes on the top surface, the boat cap also including threads around its perimeter, the boat cap being used to cover a hole granting access to an object on the boat such as a tank or other mechanical object, the apparatus comprising:

(a) a main support pole having two ends, a first end and a second end, (b) a handle having two surfaces, a top surface and a bottom surface, (c) a handle attachment having two ends, a top end and a bottom end, the top end of the handle attachment being attached to the bottom surface of the handle, the bottom end of the handle attachment being attached to the first end of the main support pole, (d) a U-shaped bracket having two arms, a first arm and a second arm, (e) wherein the second end of the main support pole is attached to the U-shaped bracket halfway in between the two arms of the U-shaped bracket, (f) further wherein the arms are coupled with the holes on the top surface of the boat cap, (g) further wherein an individual can tighten or loosen the boat cap by turning the handle.

2. An apparatus for removing boat tank caps according to claim 1 wherein the two holes on the top surface of the boat cap are equidistant from the center of the boat cap.

3. An apparatus for removing boat tank caps according to claim 2 wherein the two holes on the top surface of the boat cap are located one-hundred eighty degrees from one another in relation to the center of the boat cap.

4. An apparatus for removing boat tank caps according to claim 3 wherein the first arm and the second arm of the U-shaped bracket have the same length.

5. An apparatus for removing boat tank caps according to claim 4 wherein the first arm and the second arm of the U-shaped bracket are co-planar with the main support pole.

* * * * *